US006671984B2

(12) United States Patent
Larson

(10) Patent No.: US 6,671,984 B2
(45) Date of Patent: Jan. 6, 2004

(54) RIPPER ATTACHMENT FOR AN EXCAVATION DEVICE

(76) Inventor: David S. Larson, 5814 E. Lone Mountain, Cave Creek, AZ (US) 85331

( * ) Notice: Subject to any disclaimer, the term of this patent is extended or adjusted under 35 U.S.C. 154(b) by 0 days.

(21) Appl. No.: 10/093,243

(22) Filed: Mar. 6, 2002

(65) Prior Publication Data

US 2003/0167661 A1 Sep. 11, 2003

(51) Int. Cl.[7] ..... E02F 3/96
(52) U.S. Cl. ..... 37/404; 37/406; 37/903
(58) Field of Search ..... 37/404, 406, 903

(56) References Cited

U.S. PATENT DOCUMENTS

| | | | | | |
|---|---|---|---|---|---|
| 2,969,966 | A | | 1/1961 | Matheis | 262/14 |
| 3,061,123 | A | | 10/1962 | Rogers | 214/145 |
| 3,596,996 | A | * | 8/1971 | Carter | 299/10 |
| 3,702,712 | A | | 11/1972 | Cairns | 299/67 |
| 3,778,111 | A | | 12/1973 | Ciofani | 299/67 |
| 3,854,608 | A | * | 12/1974 | Arnold | 414/697 |
| 4,038,766 | A | | 8/1977 | Felstet | 37/141 |
| 4,041,624 | A | | 8/1977 | Fryrear | 37/117 |
| 4,204,348 | A | * | 5/1980 | Lydie | 37/404 |
| 4,616,433 | A | * | 10/1986 | Knell et al. | 37/452 |
| 5,115,583 | A | | 5/1992 | Vail | 37/103 |
| 5,197,212 | A | | 3/1993 | Vail | 37/103 |
| 5,456,028 | A | | 10/1995 | Larson | 37/404 |
| 5,634,735 | A | | 6/1997 | Horton et al. | 403/322 |
| 6,023,863 | A | * | 2/2000 | Mahin | 37/404 |
| 6,260,294 | B1 | * | 7/2001 | Pitcher | 37/406 |
| 6,408,551 | B1 | * | 6/2002 | Pettersson | 37/409 |
| 6,490,815 | B1 | * | 12/2002 | Pratt | 37/408 |

FOREIGN PATENT DOCUMENTS

| | | | | |
|---|---|---|---|---|
| EP | 508692 A1 | * | 10/1992 | E02F/3/36 |
| GB | 2083110 A | * | 3/1982 | 37/404 |

* cited by examiner

*Primary Examiner*—Robert E. Pezzuto
*Assistant Examiner*—Alexandra K. Pechhold
(74) *Attorney, Agent, or Firm*—Jordan M. Meschkow; Lowell W. Gresham; Meschkow & Gresham, PLC

(57) ABSTRACT

A ripper attachment (22) for an excavation device (20) includes first and second support members (50, 52) configured for connection to the excavation device (20). In particular, first and second support members (50, 52) are adapted to connect to a coupling apparatus (30) of a tool coupler (28) so that the ripper attachment (22) is fixed relative to the coupling apparatus (30). A body (54) of the ripper attachment (22) is disposed between the first and second support members (50, 52). The body (54) has a ripper tip (60) disposed on a distal end (62) and first and second mounting sections (64, 66) disposed on a proximal end (68). The first and second mounting sections (64, 66) of the body (54) are removably attachable to an interface area (70) of the first and second support members (50, 52). A brace element (56) of the ripper attachment (22) is interposed between and couple together the first and second support members (50, 52).

16 Claims, 4 Drawing Sheets

RIPPER ATTACHMENT FOR AN EXCAVATION DEVICE

TECHNICAL FIELD OF THE INVENTION

The present invention relates to the field of excavation machinery. More specifically, the present invention relates to ripper attachments coupled to excavation machinery for breaking up material being handled thereby.

BACKGROUND OF THE INVENTION

Ripper attachments that couple to excavation machinery, such as a backhoe, a front-end loader, an excavator, and the like have been used for supplementing and complementing the digging action of a bucket, coupled to the end of a tractor linkage, or boom, of the excavation machine. In particular, ripper attachments, which are typically welded or bolted to the bucket, facilitate the breaking up of materials generally resistant to removal. This is advantageous because the loosened material is more readily picked up by the bucket, thus enabling increased bucket loads and enhancing the efficiency of the excavation equipment.

Some ripper attachments are pivotally secured to the backside of a bucket in a position such that the ripper tip pivots about a horizontal axis to an operative position when the bucket is tucked or folded upwardly. A problem with the pivotal ripper attachment is that a load is transmitted through the ripper attachment to its pivotal axis on the bucket, and to a blunt end formed on the top side of the ripper attachment at a location where the top of the attachment contacts the bucket. The hard metal of the ripper attachment at this location can wear into and damage the bucket, or otherwise compromise the functionality of the bucket or other components of the excavation machine.

In order to simplify the task of connecting and disconnecting a tool, such as a bucket, on the tractor linkage, or boom, of the excavation machine, releasable quick change connectors, also known as tool couplers, have been developed. The tool couplers generally include a coupling apparatus on the tractor linkage and a complementary coupling element on each tool that is to be connected to the tractor linkage via the coupling apparatus. One such coupling apparatus includes a pair of spaced hooks, and the coupling element on the tool includes a cylindrical cross member at the front end of the tool. The spaced hooks are configured to engage the cylindrical cross member, and mechanisms at the rear end of the tool and coupling apparatus are interconnected to secure the tool to the boom.

There is a trend in the industry to utilize a tool coupler with excavation machinery due to the advantages of tool couplers. These advantages include, for example, enabling the tool to be coupled to the tractor linkage with a snug fit that is maintained throughout the operation of the tool, reducing wear on the tractor linkage and tool, and enabling a swinging capability of the tool. In addition, because a wide range of tools having the complementary coupling element may be employed with the coupling apparatus, there is greater utility realizable from an excavation machine, hence an attractive return on the investment of the equipment.

However, at present there are no systems that combine the features of a ripper attachment with the features of the tool coupler. Indeed, since the ripper attachment typically couples to a bucket, the ripper attachment is not available when using other tools that interconnect with the tool coupler. As such, should the services of a ripper be required, an operator of an excavation device having the tool coupler is obligated to decouple a tool that does not include the ripper attachment and secure a bucket with a ripper attachment or a separate ripper attachment in its place. This, of course, is inconvenient, time consuming, and detrimental to the object of optimizing the amount of work to be accomplished in a given amount of time. Moreover, the hard metal of the pivoting ripper attachment coupled to the bucket can pivot into and damage the coupling apparatus of the tool coupler resulting in downtime of the equipment in order to repair or replace damaged parts.

SUMMARY OF THE INVENTION

Accordingly, it is an advantage of the present invention that a ripper attachment is provided for an excavation device.

It is another advantage of the present invention that a ripper attachment is provided that is adapted to couple to a coupling apparatus of the excavation device.

Another advantage of the present invention is that a ripper attachment is provided that is configured for use with a wide variety of tools attachable to a coupling apparatus of the excavation device.

Yet another advantage of the present invention is that a ripper attachment is provided that does not compromise the functionality of a tool, boom, or coupling apparatus of the excavation device.

The above and other advantages of the present invention are carried out in one form by a ripper attachment for an excavating device. The ripper attachment includes support members configured for connection to the excavation device. A body of the ripper attachment has a ripper tip disposed on a distal end and has first and second mounting sections disposed on a proximal end. The first and second mounting sections of the body are removably attachable to an interface area of each of the support members. A brace element is interposed between the support members and couples the support members together.

The above and other advantages of the present invention are carried out in another form by an excavation device that includes a tool, a boom, and a coupling apparatus for securing the tool to the boom, and a ripper attachment. The ripper attachment includes support members attached along an upper edge of each of a pair of vertical plates of the coupling apparatus so that the ripper attachment is fixed relative to the coupling apparatus. A body of the ripper attachment has a ripper tip disposed on a distal end, and has first and second mounting sections disposed on a proximal end. The first and second mounting sections of the body are removably attachable to an interface area of each of the support members. A brace element is interposed between the support members and couples the support members together.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
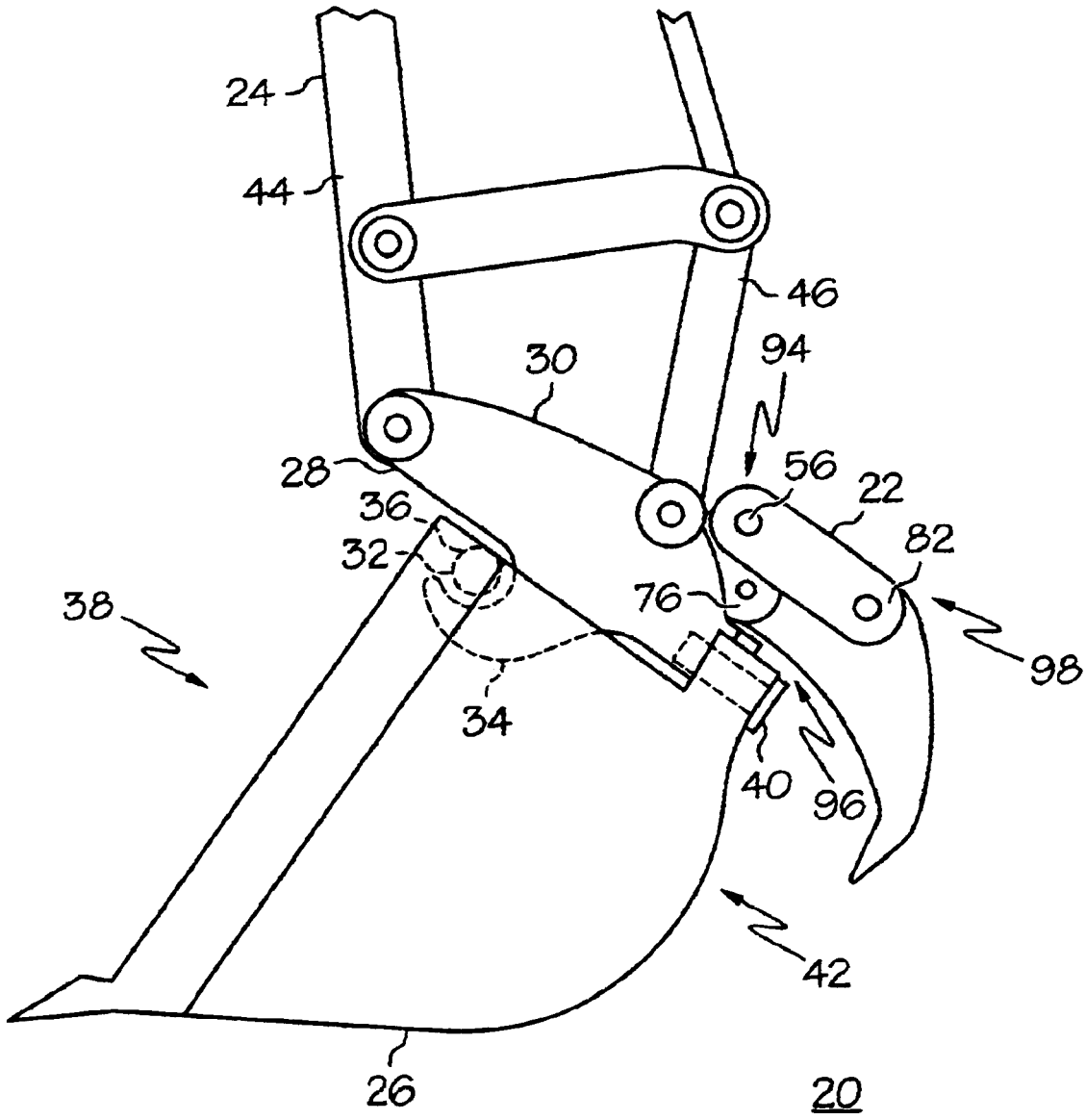
FIG. 1 shows a side view of a portion of an excavation device having a ripper attachment mounted thereto in accordance with a preferred embodiment of the present invention.

FIG. 1 shows a side view of a portion of an excavation device 20 having a ripper attachment 22 mounted thereto in accordance with a preferred embodiment of the present invention. Excavation device 20 may be a backhoe, a front-end loader, an excavator, and the like. Excavation device 20 generally includes a boom 24, or tractor linkage, and a tool 26, which by way of example, is a bucket. A tool coupler 28 secures bucket 26 to boom 24.

Tool coupler 28 includes a coupling apparatus 30 secured to boom 24 and a complementary coupling element 32 on bucket 26. Coupling apparatus 30 includes a pair of spaced hooks 34 (shown in ghost form), and coupling element 32 includes a cylindrical cross member 36 (also shown in ghost form) at a front side 38 of bucket 26. Spaced hooks 34 engage cylindrical cross member 36, and interconnecting mechanisms 40, that extend from a rearward side 42 of bucket 26 and coupling apparatus 30, secure bucket 26 to boom 24.

Excavation device 20 is shown having portions 44 and 46 of boom 24 used for raising, lowering, and manipulating ripper attachment 22 and bucket 26 under the control of a human operator (not illustrated).

Figure 2:
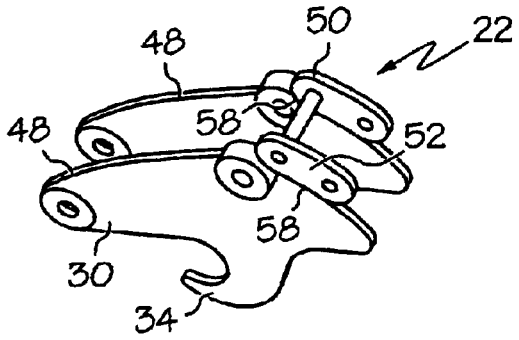
FIG. 2 shows a perspective view of a portion of the ripper attachment attached to a coupling apparatus of the excavation device of FIG. 1.
Figure 3:
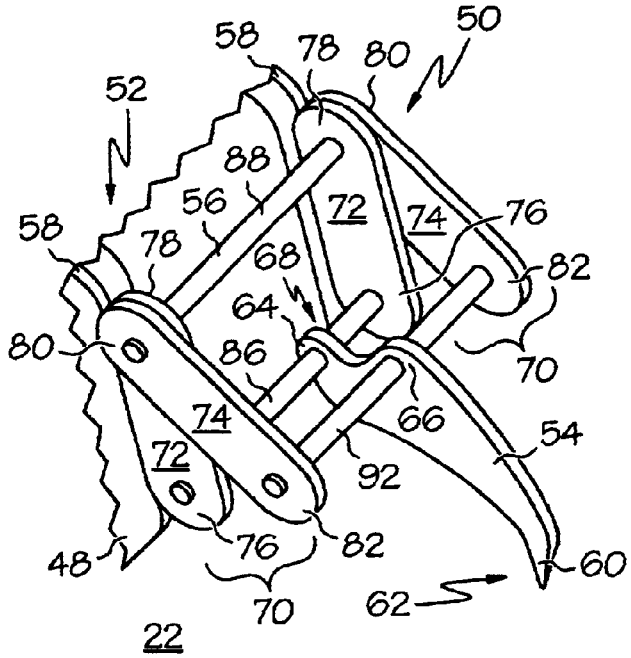
FIG. 3 shows a perspective view of the ripper attachment of FIG. 1.

Referring to FIGS. 2–3, FIG. 2 shows a perspective view of a portion of ripper attachment 22 attached to coupling apparatus 30 of tool coupler 28 (FIG. 1) of excavation device 20 (FIG. 1). FIG. 3 shows a perspective view of ripper attachment 22. Coupling apparatus 30 includes a pair of spaced vertical plates 48 that are connected in part by a cross plate (not shown).

Ripper attachment 22 includes first and second support members 50 and 52, respectively, a body 54, and a brace element 56 interposed between and coupling together first and second support members 50 and 52. Each of first and second support members 50 and 52 are configured for connection along an upper edge 58 of one of vertical plates 48 such that ripper attachment 22 is fixed relative to coupling apparatus 30.

Since ripper attachment 22 couples to coupling apparatus 30 rather than a tool, such as bucket 26, ripper attachment 22 may be used with or without bucket 26 attached to coupling apparatus 30. In addition, the connection of ripper attachment 22 independent from bucket 26 enables ripper attachment 22 to be retained in place while bucket 26 is changed so that ripper attachment 22 may be used with a wide variety of tools that interconnect with coupling apparatus 30.

In a preferred embodiment, ripper attachment 22 is retrofit onto an existing tool coupler 28 by welding first and second support members 50 and 52, respectively, to vertical plates 48 of coupling apparatus 30. However, in an alternative embodiment, first and second support members 50 and 52 may be formed integral to vertical plates 48 when tool coupler 28 is manufactured. As such, tool coupler 28 and ripper attachment 22 may be provided as a single system to operators of excavation equipment.

Body 54 of ripper attachment 22 is disposed between first and second support members 50 and 52, respectively. A ripper tip 60 is disposed on a distal end 62 of body 54. In addition, first and second mounting sections 64 and 66, respectively, are disposed on a proximal end 68 of body 54. First and second mounting sections 64 and 66 are removably attachable to an interface area 70 of first and second support members 50 and 52, respectively.

Each of first and second support members 50 and 52, respectively, of ripper attachment 22 includes a first support 72 configured for welding to one of vertical plates 48 (discussed above) and a second support 74. First support 72 has a first end 76 and a second end 78. Similarly, second support 74 has a third end 80 and a fourth end 82.

First end 76 of first support 72 constitutes a first interface section of interface area 70 and is configured for attachment, via a first pin 86, with first mounting section 64 of body 54. Third end 80 of second support 74 is configured for attachment to second end 78 of first support 72 via brace element 56. In an exemplary embodiment, brace element 56 is a second pin 88 directed through apertures at each of third ends 80 and second ends 78. Fourth end 82 of second support 74 constitutes a second interface section of interface area 70 and is configured for attachment, via a third pin 92, with second mounting section 66 of body 54.

The length of pins 86, 88, and 92 are advantageously adjusted to accommodate various sizes of coupling apparatuses 50 of a wide variety of tool couplers 28. In addition, pins 86, 88, and 92 are field-removable and field-installable for attaching body 54 to first supports 72, welded to coupling apparatus 30, as needed and for ready removal of body 54 for repair or replacement.

Referring momentarily to FIG. 1 in connection with FIG. 2, in general, ripper attachment 22 is configured such that brace element 56 is positioned at a forward side 94 of ripper attachment 22. In addition, the first interface section at first end 76 of each of first supports 72 is positioned at a bottom rearward side 96 of ripper attachment 22, and the second interface section at fourth end 82 of each of second supports 74 is positioned at a top rearward side 98 of ripper attachment 22.

Body 54 is attached to first and second support members 50 and 52, respectively, and extends from rearward side 42 of bucket 56 further from coupling apparatus 30 in a rearward direction than interconnected mechanism 40 extends from rearward side 42 of bucket 26 in the rearward direction. In operation, coupling apparatus 30 is manipulated via suitable articulation of boom 24 to allow independent use of either bucket 26 or ripper attachment 22 at the discretion of the operator (not shown). As such, ripper attachment 22 is usefully deployed for breaking up tough materials encountered in excavation (for example, caliche, shale, sandstone, blacktop, concrete, ice, frozen ground, etc.) by concentrating the force provided by boom portions 44 and 46 at ripper tip 60, rather than distributing the force along the width of bucket 26. The broken material is then readily loaded into bucket 26 for removal.

The dual connection of first and second mounting sections 64 and 66 of body 54 with first and second support members 50 and 52, respectively, retains body 54 fixed relative to coupling apparatus 30. This fixed support prevents body 54 from pivoting about either of first and third pins 86 and 92, respectively, and damaging or otherwise compromising the functionality of coupling apparatus 30, bucket 26, or boom 24 when force is concentrated at ripper tip 60. In addition, the inclusion of brace element 56 within ripper attachment 22 adds strength and overall durability to ripper attachment in order to withstand the concentrated force at ripper tip 60.

Figure 4:
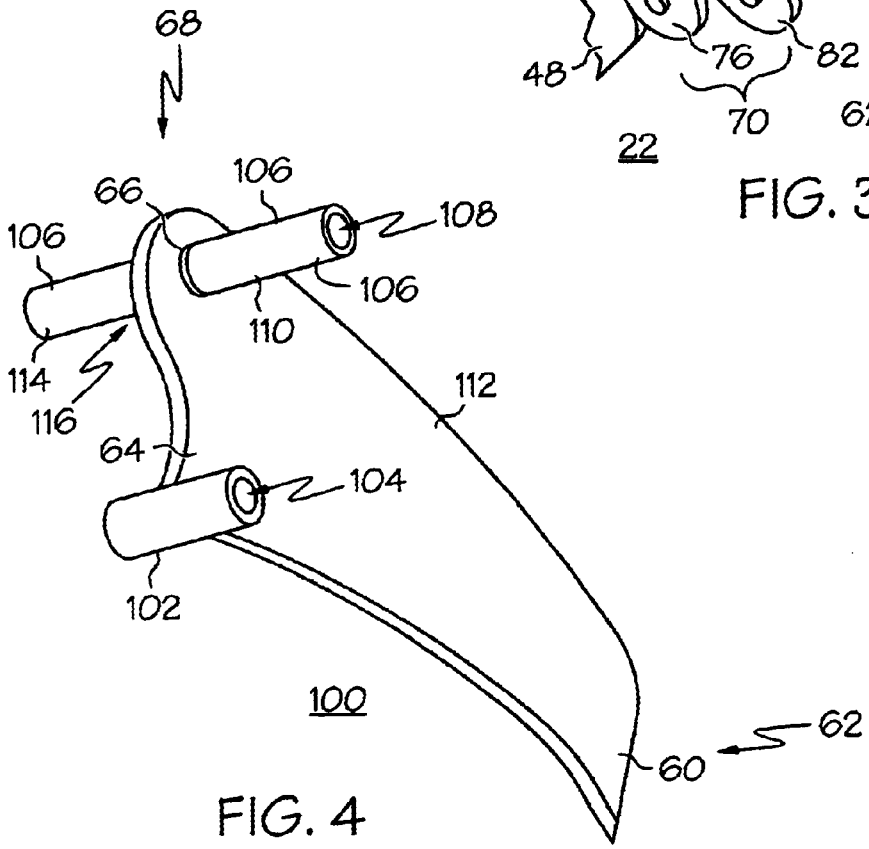
FIG. 4 shows a perspective view of a body that may be utilized on the ripper attachment of FIG. 1.

Referring FIG. 4 in connection with FIGS. 2–3, FIG. 4 shows a perspective view of a body 100 that may be utilized on ripper attachment 22 (FIG. 3). Body 54 (FIG. 3) is generally shown as a flat plate with apertures at first and second mounting sections 64 and 66, respectively, through which first and third pins 86 and 92, respectively, may be directed.

As shown, first mounting section 64 of body 100 further includes a first sleeve 102, or mounting lug, having a first aperture 104 adapted to accommodate first pin 86. Alternatively, or in addition (as shown), second mounting section 66 of body 100 includes a second sleeve 106, or mounting lug, having a second aperture 108 adapted to accommodate third pin 92.

Either or both of first and second sleeves 102 and 106 may be long enough to extend from body 100 to one of first and second support members 50 and 52, respectively, to maintain body 100 in spaced relation to first and second support members 50 and 52. By way of example, a first sleeve element 110 of second sleeve 106 is welded to a first side 112 of body 100. Likewise, a second sleeve element 114 of second sleeve 106 is welded to a second side 116 of body 100. First and second sleeve elements 110 and 114, respectively, are generally of equal length and are long enough so that a distal end 118 of each of elements 110 and 114 abut fourth end 82 of second supports 74 of ripper attachment 22. As such, body 100 remains generally centered between first and second support members 50 and 52, respectively.

Figure 5:
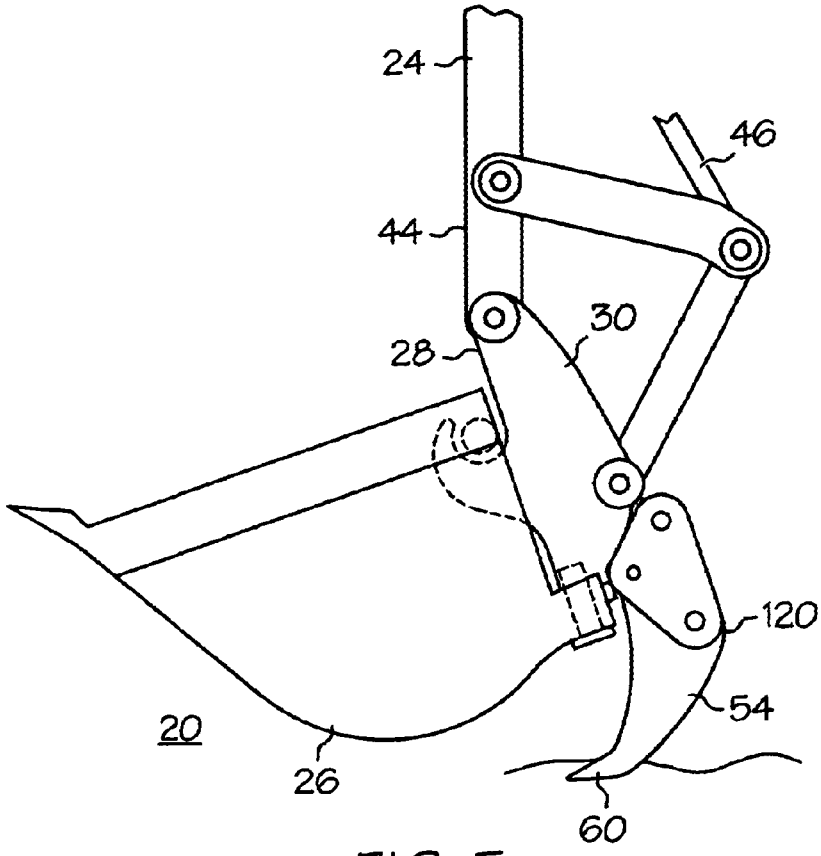
FIG. 5 shows a side view of a portion of the excavation device having a ripper attachment in accordance with a second preferred embodiment of the present invention.
Figure 6:
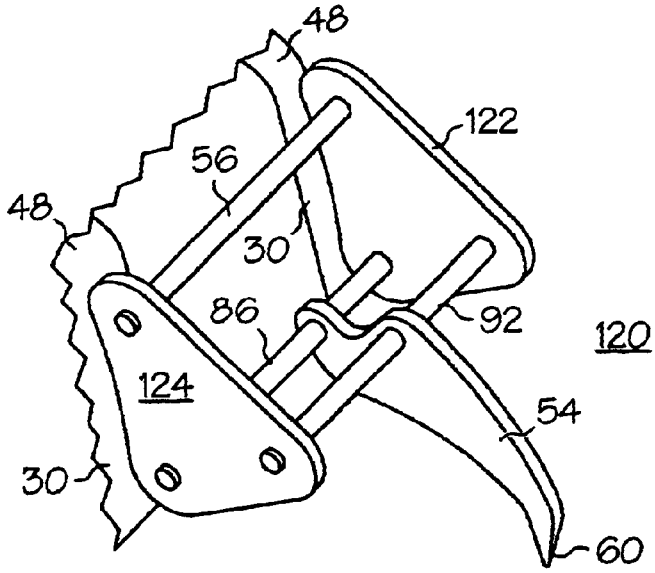
FIG. 6 shows a perspective view of the ripper attachment of FIG. 5.

Referring to FIGS. 5–6, FIG. 5 shows a side view of a portion of excavation device 20 having a ripper attachment 120 configured in accordance with a second preferred embodiment. FIG. 6 shows a perspective view of ripper attachment 120. Ripper attachment 120 includes first and second support members 122 and 124, respectively. In addition, like ripper attachment 22 (FIG. 3), ripper attachment 120 includes body 54, brace element 56 interposed between and coupling together first and second support members 122 and 124, first pin 86, and third pin 92. As shown, ripper tip 60 of ripper attachment 120 projects below bucket 26 to break up tough materials encountered during excavation.

Each of first and second support members 122 and 124 is a generally triangular-shaped plate that replaces first and second supports 72 and 74, respectively, (FIG. 3) of ripper attachment 120. First and second support members 122 and 124, respectively, are configured to attach to vertical plates 48 of coupling apparatus 30. First and second support members 122 and 124 provide a secure attachment point for brace element 56, for first and second pins 86 and 92, respectively, and consequently for body 54.

Figure 7:
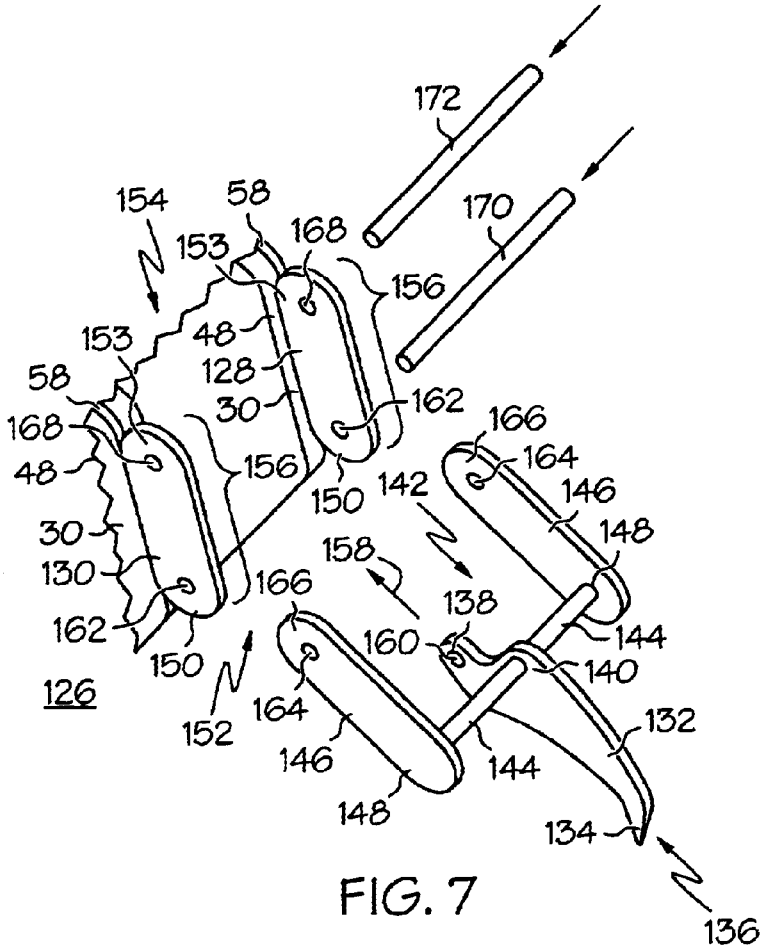
FIG. 7 shows an exploded view of a ripper attachment configured in accordance with a third preferred embodiment of the present invention.

FIG. 7 shows an exploded view of a ripper attachment 126 configured in accordance with a third preferred embodiment of the present invention. Ripper attachment 126 includes a first support member 128 and a second support member 130, each of which are configured for attachment along upper edges 58 of vertical walls 48 of coupling apparatus 30. A body 132 of ripper attachment 126 includes a ripper tip 134 at a distal end 136 of body 132, and first and second mounting sections 138 and 140 at a proximal end 142 of body 132.

Second mounting section 140 includes extensions 144 coupled to proximal end 142 of body 132 and arms 146 having an end 148 disposed on either outward end of extensions 144. Body 132, extensions 144, and arms 146 may be coupled by welding, fasteners, or other techniques known to those skilled in the art.

Each of first and second support members 128 and 130 are generally elongated in shape and conform to the shape of upper edges 58 of vertical plates 48. Each of first and second support members 128 and 130 have a first support end 150 positioned at a rearward side 152 of ripper attachment 126, and a second support end 153 positioned at a forward side 154 of ripper attachment 126. First and second support ends 150 and 153, respectively, constitute first and second interface sections of an interface area 156 of first and second support members 128 and 130.

To install body 132 of ripper attachment 126, body 132 is manipulated into place as represented by an arrow 158 and positioned such that an aperture 160 at first mounting section 138 aligns with apertures 162 at first support ends 150 of each of first and second support members 128 and 130. Similarly, apertures 164 at distal ends 166 of each of arms 146 align with apertures 168 at second support ends 153 of each of first and second support members 128 and 130. A first pin 170 is directed through aperture 162 of first support member 128, through aperture 160 at first mounting section 138 of body 132, then through aperture 162 of second support member 130. Similarly, a second pin 172 is directed through apertures 164 at distal ends 166 of arms 146 and apertures 168 at second support ends 153 of first and second support members 128 and 130, respectively.

Thus, body 132 of ripper attachment 126 including extensions 144 and arms 146 form a single durable unit that is readily installed and removed onto first and second support members 128 and 130 that are permanently connected to coupling apparatus 30 via welds.

Figure 8:
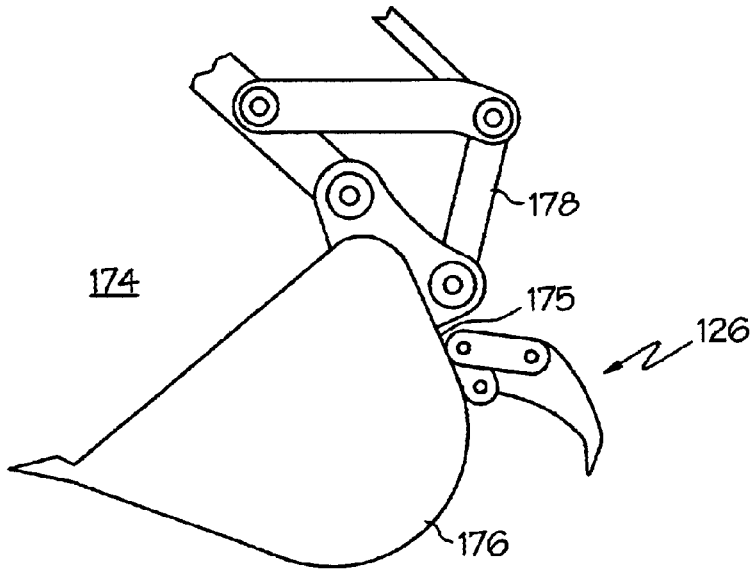
FIG. 8 shows a side view of an excavation device having the ripper attachment of FIG. 7 coupled to a rearward side of a bucket of the excavation device.

FIG. 8 shows a side view of an excavation device 174 having ripper attachment 126 coupled to a rearward side 175 of a bucket 176 of excavation device 174. Ripper attachment 22 (FIG. 3), ripper attachment 120 (FIG. 6), and ripper attachment 126 have been previously described in terms of being connected to coupling apparatus 30 (FIG. 1) of a tool coupler 28 (FIG. 1). However, in an alternative embodiment, each of ripper attachments 22, 120, and 126 may be directly welded to a tool, such as bucket 176, of an excavation device, such as device 174. Although the ripper attachment is now coupled directly to bucket 176, and can only be utilized when bucket 176 is attached to a boom 178 of excavation device 174, the ripper attachments described herein advantageously retain the feature of fixed support relative to bucket 176 so as to prevent damage to excavation device 174. In addition, the ripper attachments coupled to bucket 176 retain the feature of the inclusion of a brace element, i.e., brace element 56 (FIG. 3) and second pin 172 (FIG. 7), for strength and overall durability in order to withstand the concentrated force at the ripper tip.

In summary, the present invention teaches of a ripper attachment for an excavation device. The ripper attachment is adapted to couple to a coupling apparatus of a coupling tool, the coupling tool securing a tool, such as a bucket, to a boom of the excavation device. Since the ripper attachment couples to the coupling apparatus, the ripper attachment can be used with a wide variety of tools attachable to the coupling apparatus of the excavation device. In addition, the body of the ripper attachment includes dual connection features and a brace element for strength and overall durability so that the ripper attachment does not compromise the functionality of a tool, boom, or coupling apparatus of the excavation device.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A ripper attachment for an excavation device comprising:

support members configured for connection to said excavation device;

a body having a ripper tip disposed on a distal end, and having first and second mounting sections disposed on a proximal end, said first and second mounting sections of said body being removably attachable to an interface area of each of said support members; and a brace element interposed between said support members and coupling said support members together; and wherein each of said support members comprises:

a first support configured for connection to said excavation device, said first support having a first end and a second end, said first end being configured for attachment, via a first pin, with said first mounting section of said body; and a second support having a third end and a fourth end, said third end being configured for attachment to said second end of said first support via said brace element, and said fourth end being configured for attachment, via a second pin, with said second mounting section of said body.

2. A ripper attachment as claimed in claim 1 wherein said support members include a first support member and a second support member, and said body is disposed between said first and second support members.

3. A ripper attachment as claimed in claim 2 further comprising:

a first sleeve element positioned between said first support member and a first side of said body; and a second sleeve element positioned between said second support member and a second side of said body, said first and second sleeves maintaining said body in spaced relation to said first and second support members.

4. A ripper attachment as claimed in claim 1 wherein said excavation device includes a tool, a boom, and a coupling apparatus for securing said tool to said boom, and said support members are adapted to couple said ripper attachment to said coupling apparatus so that said ripper attachment is fixed relative to said coupling apparatus.

5. A ripper attachment as claimed in claim 4 wherein a main body of said coupling apparatus includes a pair of vertical plates, and said each of said support members is configured for attachment along an upper edge of each of said pair of vertical plates.

6. A ripper attachment as claimed in claim 4 wherein said tool and said coupling apparatus have interconnecting mechanisms that extend from a rearward side of said tool when interconnected, and said body of said ripper is configured to extend further from said coupling apparatus in a rearward direction than said interconnected mechanisms extend from said tool in said rearward direction.

7. A ripper attachment as claimed in claim 1 wherein said excavation device includes a tool removably coupled to a distal end of a boom, and said each of said support members are adapted to couple said ripper attachment to said tool.

8. A ripper attachment as claimed in claim 1 wherein said first mounting section includes a sleeve having an aperture adapted to accommodate a pin removably coupling said body to said interface area of said each of said support members.

9. A ripper attachment as claimed in claim 1 wherein said second mounting section of said body comprises:

extensions extending from opposing sides of said body; and arms, each of said arms having a first end and a second end, said first end being coupled to an end of one of said extensions remote from said body, and said second end coupling to said interface area of one of said support members.

10. A ripper attachment as claimed in claim 9 wherein said interface area of each of said support members includes:

a first interface section positioned at a rearward side of said ripper attachment, said first mounting section of said body coupling to said first interface section; and a second interface section positioned at a forward side of said ripper attachment, said second end of said each of said arms coupling to said second interface section.

11. A ripper attachment as claimed in claim 1 wherein and said interface area of each of said support members includes:

a first interface section positioned at a bottom rearward side of said ripper attachment, said first mounting section of said body coupling to said first interface section; and a second interface section positioned at a top rearward side of said ripper attachment, said second mounting section of said body coupling to said second interface section.

12. A ripper attachment as claimed in claim 1 wherein said brace element interconnects with said support members at a forward side of said ripper attachment.

13. A ripper attachment as claimed in claim 1 further comprising field-removable and field-installable pins for attaching said first and second mounting sections of said body to said support members.

14. A ripper attachment for an excavation device comprising:

a pair of support members configured for connection to said excavation device, each of said support members having a first interface area positioned at a bottom rearward side of said ripper attachment and having a second interface area;

a body disposed between said pair of support members, said body having a ripper tip disposed on a distal end, and having first and second mounting sections disposed on a proximal end, said first mounting section being removably attachable to said first interface area of each of said support members, and said second mounting section being removably attachable to said second interface area of said each of said support members; and a brace element interposed between said support members and coupling said support members together at a forward side of said ripper attachment; and wherein each of said support members comprises:

a first support configured for connection to said excavation device, said first support having said first interface section at a first end and having a second end, said first end being configured for attachment, via a first pin, to said first mounting section of said body; and a second support having a third end and having said second interface section at a fourth end, said second interface section being positioned at a top rearward side of said ripper attachment, said third end being configured for attachment to said second end of said first support via said brace element, and said fourth end being configured for attachment, via a second pin, to said second mounting section of said body.

15. A ripper attachment as claimed in claim 14 wherein said first mounting section of said body includes a sleeve having an aperture adapted to accommodate a pin removably coupling said body to said first interface area of said each of said first and second support members.

16. A ripper attachment as claimed in claim 16 wherein said second mounting section of said body comprises:

extensions extending from opposing sides of said body; and arms, each of said arms having a first end and a second end, said first end being coupled to an end of one of said extensions remote from said body, and said second end of each of said arms coupling to said second interface area of one of said support members, said second interface area being positioned at said forward side of said ripper attachment.

* * * * *

UNITED STATES PATENT AND TRADEMARK OFFICE

CERTIFICATE OF CORRECTION

PATENT NO. : 6,671,984 B2
DATED : January 6, 2004
INVENTOR(S) : David S. Larsen

It is certified that error appears in the above-identified patent and that said Letters Patent is hereby corrected as shown below:

Column 10,
Line 1, delete “16”, insert -- 14 --.

Signed and Sealed this

First Day of June, 2004

JON W. DUDAS
*Acting Director of the United States Patent and Trademark Office*